US006143456A

United States Patent [19]

Silence et al.

[11] Patent Number: 6,143,456

[45] Date of Patent: Nov. 7, 2000

[54] ENVIRONMENTALLY FRIENDLY FERRITE CARRIER CORE, AND DEVELOPER CONTAINING SAME

[75] Inventors: Scott M. Silence, Fairport; George R. Hsu, Rochester; Brian E. Moore, Ontario; Morris M. Deyoung, Jr., Farmington, all of N.Y.

[73] Assignee: Xerox Corporation, Stamford, Conn.

[21] Appl. No.: 09/444,701

[22] Filed: Nov. 24, 1999

[51] Int. Cl.[7] ..... G03G 9/107; G03G 9/113

[52] U.S. Cl. ..... 430/106.6; 430/108

[58] Field of Search ..... 430/106.6, 108

[56] References Cited

U.S. PATENT DOCUMENTS

| | | | |
|---|---|---|---|
| 3,590,000 | 6/1971 | Palermiti et al. | 430/110 |
| 4,075,391 | 2/1978 | Berg et al. | 423/633 |
| 4,233,387 | 11/1980 | Mammino et al. | 430/137 |
| 4,265,990 | 5/1981 | Stolka et al. | 430/96 |
| 4,298,672 | 11/1981 | Lu | 430/108 |
| 4,338,390 | 7/1982 | Lu | 430/106 |
| 4,368,970 | 1/1983 | Hays | 430/122 |
| 4,394,429 | 7/1983 | Hays | 430/102 |
| 4,855,208 | 8/1989 | Tada et al. | 430/110 |
| 4,898,801 | 2/1990 | Tachibana et al. | 430/106.6 |
| 4,935,326 | 6/1990 | Creatura et al. | 430/108 |
| 4,937,166 | 6/1990 | Creatura et al. | 430/108 |
| 5,236,629 | 8/1993 | Mahabadi et al. | 430/137 |
| 5,466,552 | 11/1995 | Sato et al. | 430/108 |
| 5,518,849 | 5/1996 | Sato et al. | 430/108 |
| 5,545,501 | 8/1996 | Tavernier et al. | 430/106.6 |
| 5,567,562 | 10/1996 | Creatura et al. | 430/108 |
| 5,629,120 | 5/1997 | Serizawa et al. | 430/106.6 |
| 5,709,975 | 1/1998 | Yoerger et al. | 430/106.6 |
| 5,789,129 | 8/1998 | Ochiai et al. | 430/106.6 |
| 5,876,893 | 3/1999 | Ochiai et al. | 430/106.6 |

FOREIGN PATENT DOCUMENTS

| | | | |
|---|---|---|---|
| 62-297857 | 12/1987 | Japan | 430/108 |

*Primary Examiner*—Roland Martin

*Attorney, Agent, or Firm*—Oliff & Berrridge, PLC; Eugene O. Palazzo

[57] ABSTRACT

A carrier core for use in an electrostatographic developer composition is a ferrite substantially free of copper and zinc. By being substantially free of copper and zinc, the carrier core is environmentally friendly and eliminates the need for use of conventional copper zinc carrier cores which must be handled as hazardous waste. Developer compositions employing the ferrite carrier core possess suitable properties.

13 Claims, No Drawings

ENVIRONMENTALLY FRIENDLY FERRITE CARRIER CORE, AND DEVELOPER CONTAINING SAME

BACKGROUND OF THE INVENTION

1. Field of Invention

This invention relates to an environmentally friendly ferrite carrier for use in a developer. More in particular, the invention relates to a ferrite carrier substantially free of zinc and copper, which carrier is coated with a polymer coating and used in a developer for developing latent images on a photoreceptor surface.

2. Description of Related Art

The electrostatographic process, and particularly the xerographic process, is well known. This process involves the formation of an electrostatic latent image on a photoreceptor, followed by development of the image with a developer and subsequent transfer of the image to a suitable substrate. Numerous different types of xerographic imaging processes are known wherein, for example, insulative developer particles or conductive developer particles are selected depending on the development systems used.

The use of coated carrier particles, for example in two-component developers, is well known in the art.

Carrier particles for use in the development of electrostatic latent images are described in many patents including, for example, U.S. Pat. No. 3,590,000. These carrier particles may consist of various cores, including steel, with a coating thereover of fluoropolymers, and terpolymers of styrene, methacrylate, and silane compounds.

Ferrite based carrier particles are quite common in the art. The majority of ferrite carriers are copper zinc ferrites, i.e., ferrite particles containing both copper and zinc in substantial amounts in the ferrite. See, for example, the example copper zinc ferrite carriers used in the examples and comparative examples in U.S. Pat. No. 5,545,501, and the preferred copper zinc ferrite carrier described in U.S. Pat. No. 4,898,801.

However, because of increasingly strict environmental regulations, conventional copper zinc ferrite carrier particles are considered hazardous to the environment and are classified as hazardous waste in an increasing number of states, including California.

In addition, various coatings for carrier particles for use in developers are known in the art. Recent efforts have focused on the attainment of coatings for carrier particles, for the purpose of improving development quality; and also to permit particles that can be recycled, and that do not adversely affect the imaging member in any substantial manner. Many of the present commercial coatings can deteriorate rapidly, especially when selected for a continuous xerographic process where the entire coating may separate from the carrier core in the form of chips or flakes; and fail upon impact, or abrasive contact with machine parts and other carrier particles. These flakes or chips, which cannot generally be reclaimed from the developer mixture, have an adverse effect on the triboelectric charging characteristics of the carrier particles thereby providing images with lower resolution in comparison to those compositions wherein the carrier coatings are retained on the surface of the core substrate. Further, another problem encountered with some prior art carrier coatings resides in fluctuating triboelectric charging characteristics, particularly with changes in relative humidity. The aforementioned modification in triboelectric charging characteristics provides developed images of lower quality, and with background deposits.

There is also illustrated in U.S. Pat. No. 4,233,387 coated carrier components for electrostatographic developer mixtures comprised of finely divided toner particles clinging to the surface of the carrier particles. Specifically, there is disclosed in this patent coated carrier particles obtained by mixing carrier core particles of an average diameter of from between about 30 microns to about 1,000 microns, with from about 0.05 percent to about 3.0 percent by weight, based on the weight of the coated carrier particles, of thermoplastic resin particles. The resulting mixture is then dry blended until the thermoplastic resin particles adhere to the carrier core by mechanical impaction, and/or electrostatic attraction. Thereafter, the mixture is heated to a temperature of from about 320° F. to about 650° F. for a period of 20 minutes to about 120 minutes, enabling the thermoplastic resin particles to melt and fuse on the carrier core. While the developer and carrier particles prepared in accordance with the process of this patent, the disclosure of which is incorporated herein by reference in its entirety, are suitable for their intended purposes, the conductivity values of the resulting particles are not constant in all instances, for example, when a change in carrier coating weight is accomplished to achieve a modification of the triboelectric charging characteristics; and further with regard to U.S. Pat. No. 4,233,387, in many situations carrier and developer mixtures with only specific triboelectric charging values can be generated when certain conductivity values or characteristics are contemplated.

U.S. Pat. No. 4,937,166, incorporated by reference herein in its entirety, describes a carrier composition comprised of a core with a coating thereover comprised of a mixture of first and second polymers that are not in close proximity thereto in the triboelectric series. The core is described to be iron, ferrites, steel or nickel. The first and second polymers are selected from the group consisting of polystyrene and tetrafluoroethylene; polyethylene and tetrafluoroethylene; polyethylene and polyvinyl chloride; polyvinyl acetate and tetrafluoroethylene; polyvinyl acetate and polyvinyl chloride; polyvinyl acetate and polystyrene; and polyvinyl acetate and polymethyl methacrylate. The particles are described to have a triboelectric charging value of from about −5 to about −80 microcoulombs per gram.

U.S. Pat. No. 4,935,326, incorporated by reference herein in its entirety, discloses a carrier and developer composition, and a process for the preparation of carrier particles with substantially stable conductivity parameters which comprises (1) providing carrier cores and a polymer mixture; (2) dry mixing the cores and the polymer mixture; (3) heating the carrier core particles and polymer mixture, whereby the polymer mixture melts and fuses to the carrier core particles; and (4) thereafter cooling the resulting coated carrier particles. These particulate carriers for electrophotographic toners are described to be comprised of core particles with a coating thereover comprised of a fused film of a mixture of first and second polymers which are not in close proximity in the triboelectric series, the mixture being selected from the group consisting of polyvinylidenefluoride and polyethylene; polymethyl methacrylate and copolyethylene vinyl acetate; copolyvinylidenefluoride tetrafluoroethylene and polyethylenes; copolyvinylidenefluoride tetrafluoroethylene and copolyethylene vinyl acetate; and polymethyl methacrylate and polyvinylidenefluoride.

U.S. Pat. No. 5,567,562, incorporated by reference herein in its entirety, describes a process for the preparation of conductive carrier particles which comprises mixing a carrier core with a first polymer pair and a second polymer pair, heating the mixture, and cooling the mixture, wherein the first and second polymer pair each contain an insulating polymer and a conductive polymer and wherein the carrier conductivity thereof is from about $10^{-6}$ to about $10^{-14}$ $(ohm\text{-}cm)^{-1}$. The first polymer pair is preferably comprised of an insulating polymethyl methacrylate and a conductive polymethyl methacrylate, and the second polymer pair is preferably comprised of an insulating polyvinylidenefluoride and a conductive polyvinylidenefluoride.

SUMMARY OF THE INVENTION

It is therefore an object of the invention to attain an environmentally friendly carrier particle that possesses properties similar to conventional copper zinc ferrite carrier particles. It is a further object of the present invention to attain a carrier in which the core is powder coated with two polymers having different polarities, which coated carrier can be used in a developer.

These and other objects of the present invention are achieved herein. The present invention relates to a coated carrier for use in a developer comprising a core particle comprised of ferrite substantially free of copper and zinc coated with a coating containing one or more polymers.

In addition, the present invention also relates to a developer comprising coated carriers comprising a core particle comprised of ferrite substantially free of copper and zinc coated with a coating containing one or more polymers, and toner particles.

The coated carrier composition of this invention is environmentally friendly and has excellent properties ideally suited for particular use in a developer for an electrostatographic printing device.

DETAILED DESCRIPTION OF PREFERRED EMBODIMENTS

The carrier of the present invention comprises ferrite particles that are substantially free of both zinc and copper. By "substantially free of" is meant that the ferrite particles contain less than 2,000 ppm copper and less than 4,000 ppm zinc on a weight basis of the ferrite particle, which values correspond approximately to less than 0.25 wt. % copper oxide and less than 0.50 wt. % zinc oxide on the basis of the overall ferrite particle weight.

Preferably, the ferrite particles contain less than 1,000 ppm copper, more preferably less than 250 ppm copper, and most preferably less than 150 ppm copper, on a weight basis of the ferrite particle and less than 1,000 ppm zinc, more preferably less than 250 ppm zinc, and most preferably less than 100 ppm zinc, on a weight basis of the ferrite particle.

The ferrite particles used as carrier cores in the present invention thus contain copper and zinc merely as impurities at most. By utilizing a ferrite particle substantially free of copper and zinc as the carrier core, an environmentally friendly carrier and developer is achieved, which carrier does not have to be handled as hazardous waste after use. Surprisingly, such carrier possesses properties highly similar to conventional copper zinc ferrite cores and thus can be made to replace such cores without the need to substantially alter the coating composition and/or printing machine parameters.

That is, developers made from ferrite carrier particles that are substantially free of copper and zinc can be used in place of developers using copper zinc ferrite carrier cores with only minimal adjustment of coating composition or coating process conditions (in order to meet the triboelectric and electrostatic developer characteristics required for a particular printing machine) and/or with only minimal adjustment of the developing process parameters (voltage, etc.) of the printing machine. Coating composition adjustments of this type can include changes to the total coating weight of the polymeric coating on the surface of the core, generally less than an increase or decrease of 0.5% of the core weight, changes in the ratio of two polymers on the surface of the core, generally less than a 30% change to the ratio, and coating process condition adjustments can include changes to the processing temperature or residence time during which a composition experiences a particular process step. Adjustment to the developing process parameters of this type can include changes in the optical exposure of a photoreceptor to an imaging device or changes to a voltage applied between a magnetic developer roll and a photoreceptor.

The ferrite particles substantially free of copper and zinc according to the invention may be commercially obtained, for example from Powdertech under the code EFC-50BX. This ferrite contains approximately 114 ppm copper and 75 ppm zinc, on average.

If desired, the ferrite particles can be prepared by any well known ferrite particle preparation technique. A general technique for preparing ferrite based particles as described in, for example, U.S. Pat. No. 4,898,801 could be used in preparing a ferrite substantially free of copper and zinc of the present invention, even though this patent describes the preparation of copper zinc ferrites. The ferrite is preferably prepared from the start so as to be substantially free of copper and zinc (containing both in only impurity amounts at most as discussed above), but may also be made to be substantially free of copper and zinc through the use of known extraction techniques and formation of the particles.

The ferrite particles to be used as cores in the invention preferably have an average particle size (diameter) of from, for example, 10 to 100 microns, preferably 30 to 80 microns, most preferably 30 to 55 microns as determined by standard laser diffraction techniques. In addition, the ferrite core particles have a magnetic saturation of, for example, 30 to 110 emu/g, preferably 40 to 100 emu/g, more preferably 50 to 75 emu/g, most preferably 60 to 65 emu/g, a powder density as determined by ASTM Test B-212-89 of 2.0 to 3.0 $g/cm^3$, preferably 2.2 to 2.5 $g/cm^3$, most preferably about 2.40 $g/cm^3$, a conductivity of 2 to $10\times10^{-10}$ $(ohm\text{-}cm)^{-1}$, most preferably of about $6\times10^{-10}$ $(ohm\text{-}cm)^{-1}$ and a breakdown voltage of 700 to 1000 V, most preferably of about 850 V. The conductivity of the core is measured by applying a 200 Volt fixed voltage across a 0.1 inch magnetic brush in a static (non-rotating) mode. The resultant current flow through the material is used to calculate the conductivity of the core. The voltage breakdown of the core is measured by applying a fixed rate of increasing voltage across 0.1 inch magnetic brush while under rotation. The applied voltage at which 100 microamps of current flows through the sample is defined as the breakdown voltage.

The carrier of the present invention comprises the ferrite core particles of the invention coated thereover with a polymer coating. Any polymer coating known in the art may be used.

In a most preferred embodiment, the ferrite particles substantially free of copper and zinc are coated with a mixture of at least two dry polymer components, which dry polymer components are preferably not in close proximity thereto in the triboelectric series, and most preferably of opposite charging polarities with respect to the toner selected.

The electronegative polymer, i.e., the polymer that will generally impart a positive charge on the toner which it is contacted with, is preferably comprised of a polyvinylidenefluoride polymer or copolymer. Such polyvinylidenefluoride polymers are commercially available, for example under the tradename Kynar from Elf Atochem. Kynar 301F is polyvinylidenefluoride and Kynar 7201 is copolyvinylidenefluoride tetrafluoroethylene.

The electropositive polymer, i.e., the polymer that will generally impart a negative charge on the toner which it is contacted with is preferably comprised of a polymer or copolymer of polymethyl methacrylate (PMMA), optionally having carbon black or another conductive material dispersed therein. PMMA by itself is an insulative polymer. To obtain conductive PMMA, a conductive component, for example carbon black, is dispersed in the polymer.

The PMMA may be copolymerized with any desired comonomer, so long as the resulting copolymer retains a suitable particle size. Suitable comonomers can include monoalkyl, or dialkyl amines, such as a dimethylaminoethyl methacrylate, diethylaminoethyl methacrylate, diisopropylaminoethyl methacrylate, or t-butylaminoethyl methacrylate; and the like. If the PMMA polymer has carbon black dispersed therein, it is preferably formed in a semisuspension polymerization process, for example as described in U.S. Pat. No. 5,236,629, incorporated by reference herein in its entirety.

The percentage of each polymer present in the carrier coating mixture can vary depending on the specific components selected, the coating weight and the properties desired. In particular, the ratios of the two polymers may be varied in order to adjust the triboelectric characteristics of the carrier in order to meet the particular A(t) requirements of a given printing device. Generally, the coated polymer mixtures used contain from about 3 to about 97 percent of the electronegative polymer, and from about 97 to about 3 percent by weight of the electropositive polymer. Preferably, there are selected mixtures of polymers with from about 3 to 25 percent by weight of the electronegative polymer, and from about 75 to 97 percent by weight of the electropositive polymer. Most preferably, there are selected mixtures of polymers with from about 5 to 20 percent by weight of the electronegative polymer, and from about 80 to 95 percent by weight of the electropositive polymer.

The carrier particles may be prepared by mixing the carrier core with from, for example, between about 0.05 to about 10 percent by weight, more preferably between about 0.05 percent and about 3 percent by weight, based on the weight of the coated carrier particles, of the mixture of dry polymers until adherence thereof to the carrier core by mechanical impaction and/or electrostatic attraction. The mixture of carrier core particles and polymers is then heated to a temperature of, for example, between from about 200° F. to about 650° F., preferably 320° F. to 550° F., most preferably 380° F. to 420° F., for a period of time of from, for example, about 10 minutes to about 60 minutes, enabling the polymers to melt and fuse to the carrier core particles. The coated carrier particles are then cooled and thereafter classified to a desired particle size. The coating preferably has a coating weight of from, for example, 0.1–3.0% by weight of the carrier, preferably 0.1–1.0% by weight.

Various effective suitable means can be used to apply the polymer mixture coatings to the surface of the carrier core particles. Examples of typical means for this purpose include combining the carrier core material and the mixture of polymers by cascade roll mixing, or tumbling, milling, shaking, electrostatic powder cloud spraying, fluidized bed, electrostatic disc processing, and an electrostatic curtain. Following application of the polymer mixture, heating is initiated to permit flowout of the coating material over the surface of the carrier core. The concentration of the coating material powder particles, as well as the parameters of the heating step, may be selected to enable the formation of a continuous film of the coating material on the surface of the carrier core, or permit only selected areas of the carrier core to be coated.

Developers incorporating the coated carriers of the present invention can be formulated with constant conductivity values with different triboelectric charging characteristics by, for example, maintaining the same coating weight on the carrier particles and changing the polymer coating ratios. Similarly, there can be formulated developer compositions wherein constant triboelectric charging values are achieved and the conductivities are altered by retaining the polymer ratio coating constant and modifying the coating weight for the carrier particles.

In a most preferred embodiment of the present invention, the coated carriers are used in forming developers for use in production color machines capable of making two sided prints, for example printing devices employing a print engine manufactured by Xeikon NV. The electrophotographic development technology used in such a print engine is conventional image formation on a photoreceptor using a light emitting diode (LED) imaging bar, followed by image development using conventional two component magnetic brush development. Such print engine typically has a machine functional requirement of A(t) of about 300, where A(t) is defined as the product of the triboelectric value as measured by the known Faraday Cage process and the sum of the measured toner concentration (TC) plus an constant value of 8, that is A(t)=tribo×(TC+8). Such a device is commercially available from Xerox as Xerox DocuColor 70. For these types of devices, Xeikon NV markets a full line of color developers (cyan, yellow, magenta and black) employing copper zinc ferrite carrier cores. Developers formed with ferrite carrier cores of the present invention could thus be ideally used to replace such developers, and can readily be made to meet the A(t) requirements of such print engine as discussed above.

The coated carrier preferably possesses a conductivity of from, for example, about 0.5 to $10.0\times10^{-11}$ $(\text{ohm-cm})^{-1}$, most preferably of from about 1.0 to $6.0\times10^{-11}$ $(\text{ohm-cm})^{-1}$, and a breakdown voltage of from, for example, 1400 to 2300 V, most preferably of from 1550 to 2200 V.

Two component developer compositions of the present invention can be generated by admixing the carrier core particles with a toner composition comprised of resin particles and pigment particles. The toner concentration in the developer initially installed in a xerographic development housing is between 3.5 and 5 parts of toner per one hundred parts of carrier. Over the life of the developer, this concentration can vary from about 3.5 to about 7 parts of toner per one hundred parts of carrier with no significant impart on the copy quality of the resulting images.

Illustrative examples of finely divided toner resins selected for the developer compositions of the present invention include polyamides, epoxies, polyurethanes, diolefins, vinyl resins, styrene acrylates, styrene methacrylates, styrene butadienes, polyesters such as the polymeric esterification products of a dicarboxylic acid and a diol comprising a diphenol, crosslinked polyesters, and the like. Specific vinyl monomers include styrene, p-chlorostyrene vinyl naphthalene, unsaturated monoolefins such as ethylene, propylene, butylene and isobutylene; vinyl halides such as vinyl chloride, vinyl bromide, vinyl fluoride, vinyl acetate, vinyl propionate, vinyl benzoate, and vinyl butyrate; vinyl esters like the esters of monocarboxylic acids including methyl acrylate, ethyl acrylate, n-butyl-acrylate, isobutyl acrylate, dodecyl acrylate, n-octyl acrylate, 2-chloroethyl acrylate, phenyl acrylate, methylalphachloracrylate, methyl methacrylate, ethyl methacrylate, and butyl methacrylate; acrylonitrile, methacrylonitrile, acrylamide, vinyl ethers, inclusive of vinyl methyl ether, vinyl isobutyl ether, and vinyl ethyl ether; vinyl ketones inclusive of vinyl methyl ketone, vinyl hexyl ketone and methyl isopropenyl ketone; vinylidene halides such as vinylidene chloride and vinylidene chlorofluoride; N-vinyl indole, N-vinyl pyrrolidone; and the like. Also, there may be selected styrene butadiene copolymers, mixtures thereof, and the like.

As one toner resin there can be selected the esterification products of a dicarboxylic acid and a diol comprising a diphenol, reference U.S. Pat. No. 3,590,000, the disclosure of which is totally incorporated herein by reference. Other preferred toner resins include styrene/methacrylate copolymers; styrene/butadiene copolymers; polyester resins obtained from the reaction of bisphenol A and propylene oxide; and branched polyester resins resulting from the reaction of dimethyl terephthalate, 1,3-butanediol, 1,2-propanediol and pentaerythritol, and reactive extruded polyesters. Generally, from about 1 part to about 5 parts by weight of toner particles are mixed with from about 10 to about 300 parts by weight of the carrier particles of the present invention.

Numerous well known suitable pigments or dyes can be selected as the colorant for the toner particles including, for example, carbon black like REGAL 330, nigrosine dye, lamp black, iron oxides, magnetites, colored magnetites other than black, and mixtures thereof. The pigment, which is preferably carbon black, should be present in a sufficient amount to render the toner composition highly colored. Thus, the pigment particles can be present in amounts of from about 3 percent by weight to about 20 and preferably from 5 to about 15 percent by weight, based on the total weight of the toner composition, however, lesser or greater amounts of pigment particles may be selected in embodiments.

When the pigment particles are comprised of magnetites, which are a mixture of iron oxides (FeO, $Fe_2O_3$) including those commercially available as MAPICO BLACK, they are present in the toner composition in an amount of from about 10 percent by weight to about 70 percent by weight, and preferably in an amount of from about 20 percent by weight to about 50 percent by weight.

The resin particles are present in a sufficient, but effective amount, thus when 10 percent by weight of pigment, or colorant such as carbon black is contained therein, about 90 percent by weight of resin material is selected. Generally, however, the toner composition is comprised of from about 85 percent to about 97 percent by weight of toner resin particles, and from about 3 percent by weight to about 15 percent by weight of pigment particles such as carbon black.

Also encompassed within the scope of the present invention are colored toner and developer compositions comprised of toner resin particles, carrier particles, and as pigments or colorants, red, green, brown, blue, magenta, cyan and/or yellow particles, as well as mixtures thereof. More specifically, illustrative examples of magenta materials that may be selected as pigments include 1,9-dimethyl-substituted quinacridone and anthraquinone dye identified in the color index as CI 60720, CI Dispersed Red 15, a diazo dye identified in the color index as CI 26050, CI Solvent Red 19, and the like. Examples of cyan materials that may be used as pigments include copper tetra-4(octaecyl sulfonamido) phthalocyanine, X-copper phthalocyanine pigment listed in the color index as CI 74160, CI Pigment Blue, and Anthrathrene Blue, identified in the color index as CI 69810, Special Blue X-2137, and the like; while illustrative examples of yellow pigments that may be selected are diarylide yellow 3,3-dichlorobenzidene acetoacetanilides, a monoazo pigment identified in the color index as CI 12700, CI Solvent Yellow 16, a nitrophenyl amine sulfonamide identified in the color index as Foron Yellow SE/GLN, CI Dispersed Yellow 33, 2,5-dimethoxy-4-sulfonanilide phenylazo-4'-chloro-2,5-dimethoxy acetoacetanilide, permanent yellow FGL, and the like. These pigments are generally present in the toner composition in an amount of from about 1 weight percent to about 15 weight percent based on the weight of the toner resin particles.

For further enhancing the positive charging characteristics of the developer compositions described herein, and as optional components there can be incorporated into the toner or on its surface charge enhancing additives inclusive of alkyl pyridinium halides, reference U.S. Pat. No. 4,298,672, the disclosure of which is totally incorporated herein by reference; organic sulfate or sulfonate compositions, reference U.S. Pat. No. 4,338,390, the disclosure of which is totally incorporated herein by reference; distearyl dimethyl ammonium sulfate; bisulfates, and the like and other similar known charge enhancing additives. Also, negative charge enhancing additives may also be selected, such as aluminum complexes, like BONTRON E-88, and the like. These additives are usually incorporated into the toner in an amount of from about 0.1 percent by weight to about 20 percent by weight, and preferably from 1 to about 3 percent by weight.

The toner composition of the present invention can be prepared by a number of known methods including melt blending the toner resin particles, and pigment particles or colorants followed by mechanical attrition. Other methods include those well known in the art such as spray drying, melt dispersion, dispersion polymerization, suspension polymerization, and extrusion. In one dispersion polymerization method, a solvent dispersion of the resin particles and the pigment particles is spray dried under controlled conditions to result in the desired product. Generally, the toners are prepared by mixing, followed by attrition, and classification to enable toner particles with an average volume diameter of from about 5 to about 20 microns.

Also, the toner and developer compositions of the present invention may be selected for use in electrostatographic imaging processes containing therein conventional photoreceptors, including inorganic and organic photoreceptor imaging members. Examples of imaging members are selenium, selenium alloys, and selenium or selenium alloys containing therein additives or dopants such as halogens. Furthermore, there may be selected organic photoreceptors illustrative examples of which include layered photoresponsive devices comprised of transport layers and photogenerating layers, reference U.S. Pat. No. 4,265,990, the disclosure of which is totally incorporated herein by reference, and other similar layered photoresponsive devices. Examples of generating layers are trigonal selenium, metal phthalocyanines, metal free phthalocyanines and vanadyl phthalocyanines. As charge transport molecules there can be selected the aryl diamines disclosed in U.S. Pat. No. 4,265,990. Also, there can be selected as photogenerating pigments squaraine compounds, thiapyrillium materials, and the like. These layered members are conventionally charged negatively thus requiring a positively charged toner. Moreover, the developer compositions of the present invention are particularly useful in electrostatographic imaging processes and apparatuses wherein there are selected a moving transporting means and a moving charging means; and wherein there is selected a deflected flexible layered imaging member, reference U.S. Pat. Nos. 4,394,429 and 4,368,970, the disclosures of which are totally incorporated herein by reference.

The invention will now be further explained by way of the following examples.

EXAMPLE 1

In this example, the properties of a ferrite core substantially free of copper and zinc of the invention are compared to properties of a copper zinc ferrite core. The results are summarized in Table 1. The ferrite core substantially free of copper and zinc is EFC-50BX obtained from Powdertech. The copper zinc ferrite core is FB3035, also obtained from Powdertech, and is believed to be equivalent to the core used in Xeikon developers.

TABLE 1

| | Ferrite Substantially Free of Copper and Zinc | Copper Zinc Ferrite |
|---|---|---|
| Particle Size | 49.8 $\mu$m | 52.2 $\mu$m |
| Density | 2.39 g/cm$^3$ | 2.70 g/cm$^3$ |
| Breakdown Voltage | 859 V | 690 V |
| Conductivity | $6.4 \times 10^{-10}$ (ohm-cm)$^{-1}$ | $1.4 \times 10^{-9}$ (ohm-cm)$^{-1}$ |
| Saturation Magnetization | 63 emu/g | 65 emu/g |
| Metal Composition: | | |
| Fe | 50.6% | 49.2% |
| Mn | 18.5% | 0.2% |
| Mg | 2.3% | 0.1% |
| Sr | 0.56% | 0 |
| Cu | 114 ppm | 14.8% |
| Zn | 75 ppm | 18.0% |

EXAMPLE 2

In this example, each of a black, magenta, yellow and cyan developer are prepared using the ferrite core substantially free of zinc and copper of Example 1.

In the first step of the carrier coating process, the carrier core particles are mixed in a Munson blender with a Kynar/PMMA polymer mixture, where the Kynar is Kynar 301F obtained from Elf Atochem and the PMMA is MP116 Fines, obtained from Soken Chemical Company. For the magenta and black developers (Carrier 1), the ratio of Kynar/PMMA is 5/95, while for the yellow and cyan developers (Carrier 2), the ratio is 20/80. Sufficient polymer mixture is provided to derive a final coating weight of 0.4%. In the second step of the coating process, the polymers are fused in a rotary kiln maintained at a temperature of 385F., and the residence time of the carrier in the furnace is maintained at 30 minutes.

The coated carriers are evaluated for carrier breakdown voltage and conductivity. For comparison, the coated carriers are compared to coated carriers used in Xeikon NV developers. The Xeikon NV carrier is believed to be coated with a poly(dimethylsiloxane) polymer at a coating weight of between 0.1 and 0.17%, based on the weight of the coated carrier. The results are summarized in Table 2.

TABLE 2

| | Carrier 1 | Carrier 2 | Xeikon NV Carrier |
|---|---|---|---|
| Breakdown Voltage | 1978 V | 1948 V | 1330 V |
| Conductivity | $2.3 \times 10^{-11}$ (ohm-cm)$^{-1}$ | $4.1 \times 10^{-11}$ (ohm-cm)$^{-1}$ | $4.0 \times 10^{-11}$ (ohm-cm)$^{-1}$ |

Each of the respective color developers is then prepared. The toner concentration of the developers is 3.5 parts of toner per one hundred parts of carrier, independent of the color of the developer. Each of the black, magenta, yellow and cyan developers that include the ferrite carrier core of the invention are able to achieve the machine A(t) of 300 for use in printing devices employing Xeikon print engines.

EXAMPLE 3

In this example, the properties of three additional ferrite cores substantially free of copper and zinc of the invention are compared to properties of a copper zinc ferrite core. The results of the three cores are summarized in Table 3, and can be compared to the properties of a copper zinc ferrite core summarized in Table 1. The ferrite cores substantially free of copper and zinc are EFC-50A and FCX5488, both obtained from Powdertech, and EXEF-150, obtained from DM Steward Corporation.

TABLE 3

| | EFC-50A | FCX5488 | EXEF-150 |
|---|---|---|---|
| Particle Size | 47.9 $\mu$m | 48 $\mu$m | 48.6 $\mu$m |
| Density | 2.41 g/cm$^3$ | 2.36 g/cm$^3$ | 2.44 g/cm$^3$ |
| Breakdown Voltage | 1515 V | 162 V | 1084 V |
| Conductivity | $2.1 \times 10^{-9}$ (ohm-cm)$^{-1}$ | $4.3 \times 10^{-8}$ (ohm-cm)$^{-1}$ | $5.7 \times 10^{-10}$ (ohm-cm)$^{-1}$ |
| Saturation Magnetization | 61 emu/g | 62 emu/g | 63 emu/g |
| Metal Composition: | | | |
| Fe | 50.4% | 53.8% | 53.1% |
| Mn | 0 | 14.9% | 14.9% |
| Mg | 6.0% | 45 ppm | 2.75% |
| Sr | 0 | 130 ppm | 0 |
| Cu | <200 ppm | 260 ppm | 400 ppm |
| Zn | <200 ppm | 0.73% | 720 ppm |
| Li | 4.5% | 0 | 0 |
| Ca | 2.1% | 0 | 0 |

What is claimed is:

1. A coated carrier for use in a developer comprising a core particle comprised of ferrite substantially free of copper and zinc coated with a coating comprised of a mixture of a negatively charging polymer and a positively charging polymer.

2. The coated carrier according to claim 1, wherein the ferrite substantially free of copper and zinc contains less than 1,000 ppm copper and less than 1,000 ppm zinc on a weight basis of the ferrite particle.

3. The coated carrier according to claim 1, wherein the ferrite substantially free of copper and zinc contains less than 150 ppm copper and less than 100 ppm zinc on a weight basis of the ferrite particle.

4. The coated carrier according to claim 1, wherein the negatively charging polymer comprises a polyvinylidenefluoride polymer or copolymer and the positively charging polymer comprises a polymethyl methacrylate polymer or copolymer.

5. The coated carrier according to claim 1, wherein the core particle has an average particle size of from 10 to 100 microns, a magnetic saturation of from 30 to 110 emu/g, a density of from 2.0 to 3.0 g/cm$^3$, and a breakdown voltage of from 700 to 1000 V.

6. The coated carrier according to claim 1, wherein the core particle has an average particle size of from 30 to 80 microns, a magnetic saturation of from 40 to 100 emu/g, and a density of from 2.2 to 2.5 g/cm$^3$.

7. A developer comprising coated carriers comprising a core particle comprised of ferrite substantially free of copper and zinc coated with a coating comprised of a mixture of a negatively charging polymer and a positively charging polymer, and toner particles.

8. The developer according to claim 7, wherein the toner particles comprise coloring substances that are yellow, magenta, cyan, black or mixtures thereof.

9. The developer according to claim 7, wherein the ferrite substantially free of copper and zinc contains less than 1,000 ppm copper and less than 1,000 ppm zinc on a weight basis of the ferrite particle.

10. The developer according to claim 7, wherein the ferrite substantially free of copper and zinc contains less than 150 ppm copper and less than 100 ppm zinc on a weight basis of the ferrite particle.

11. The developer according to claim 7, wherein the negatively charging polymer comprises a polyvinylidene-fluoride polymer or copolymer and the positively charging polymer comprises a polymethyl methacrylate polymer or copolymer.

12. The developer according to claim 7, wherein the core particle has an average particle size of from 10 to 100 microns, a magnetic saturation of from 30 to 110 emu/g, a density of from 2.0 to 3.0 g/cm$^3$, and a breakdown voltage of from 700 to 1000 V.

13. The developer according to claim 7, wherein the core particle has an average particle size of from 30 to 80 microns, a magnetic saturation of from 40 to 100 emu/g, and a density of from 2.2 to 2.5 g/cm$^3$.

* * * * *